United States Patent [19]

Saffrahn

[11] 4,142,328

[45] Mar. 6, 1979

[54] SAFETY ROLLER ASSEMBLY FOR PLUG DOORS

[75] Inventor: Fred C. Saffrahn, Crete, Ill.

[73] Assignee: Pullman Incorporated, Chicago, Ill.

[21] Appl. No.: 834,731

[22] Filed: Sep. 19, 1977

[51] Int. Cl.[2] ..... E05D 15/10

[52] U.S. Cl. ..... 49/220

[58] Field of Search ..... 49/220

[56] References Cited

U.S. PATENT DOCUMENTS

| | | | |
|---|---|---|---|
| 3,797,170 | 3/1974 | Lemon | 49/220 |
| 3,913,269 | 10/1975 | Ross, Jr. | 49/220 |
| 4,043,078 | 8/1977 | Dyche | 49/220 |

*Primary Examiner*—Kenneth Downey
*Attorney, Agent, or Firm*—Thomas G. Anderson

[57] ABSTRACT

A safety roller assembly in a plug door for a railway car is disclosed which includes a safety roller traveling in a retaining guide with a recess being formed in the lower support surface of the retaining guide to receive a safety crank connected to the safety roller when the plug door is closed. A safety shoe is provided beneath the safety roller to prevent it from ever falling through the recess in the lower support surface.

5 Claims, 6 Drawing Figures

SAFETY ROLLER ASSEMBLY FOR PLUG DOORS

BACKGROUND OF THE INVENTION

1. Field of the Invention

The present invention relates to plug doors for railway cars and, in particular, to safety devices to prevent these doors from falling over and causing damage when they become derailed.

2. Description of the Prior Art

The prior art is generally cognizant of railway plug doors having safety rollers to help support the plug door when it is derailed. Such a safety roller is shown in U.S. Pat. No. 3,913,269. It has been a problem with such a roller that inasmuch as it is necessary to provide recesses in the retaining guide in which they must travel, there is no sure way to make sure that the safety roller cannot pass through one of these recesses to become freed from the retaining guide and thereby useless. Other prior art plug doors are shown in U.S. Pat. No. RE 27,029, No. 2,658,243, No. 2,765,502, No. 3,332,168 and No. 3,339,323.

SUMMARY OF THE INVENTION

The present invention is summarized in that a plug door assembly includes a wall having an opening therein, a generally planar plug door filling the opening in the wall in its closed position, an upper retaining guide positioned on the wall above the opening and including a lower support surface, a lower guide rail positioned on the wall below the opening, a pair of vertical operating rods rotatably secured in the plug door, handle means to cause rotation of the operating rods, a connecting crank at each end of each of the operating rods, a roller assembly attached to the lower connecting crank of each operating rod entrained for traveling along the lower guide rail, a roller attached to the upper connecting crank of each operating rod and received within the upper retaining guide, the rotation of the operating rods causing the connecting cranks to rotate to lift the plug door out of the opening in the wall so that it may travel along the lower guide rail, a safety crank rotatably secured to the plug door, a safety roller pin rotatably received within the end of the safety crank away from the plug door, a safety roller on the safety roller pin received within the upper retaining guide, the lower support surface of the upper retaining guide having at least one recess formed in it to receive the safety crank when the plug door is in its closed position, and a safety shoe attached to the lower end of the safety roller pin underneath the safety crank, the safety shoe being an elongated member longer than the recess in the lower support surface and serving to prevent the safety roller from ever being drawn through the recess in the lower support surface.

An object of the present invention is to construct a safety roller assembly for a plug door that cannot become freed from its retaining guide to allow the plug door to fall over.

Another object of the present invention is to achieve such a fail-safe safety roller assembly without the need for critically sized or low tolerance parts.

It is yet another object of the present invention to provide such a safety roller assembly that in no way interferes with the normal operation of the plug door.

Other objects, advantages and features of the present invention will become apparent from the following specification when taken in conjunction with the accompanying drawings.

DESCRIPTION OF THE PREFERRED EMBODIMENT

Figure 1:
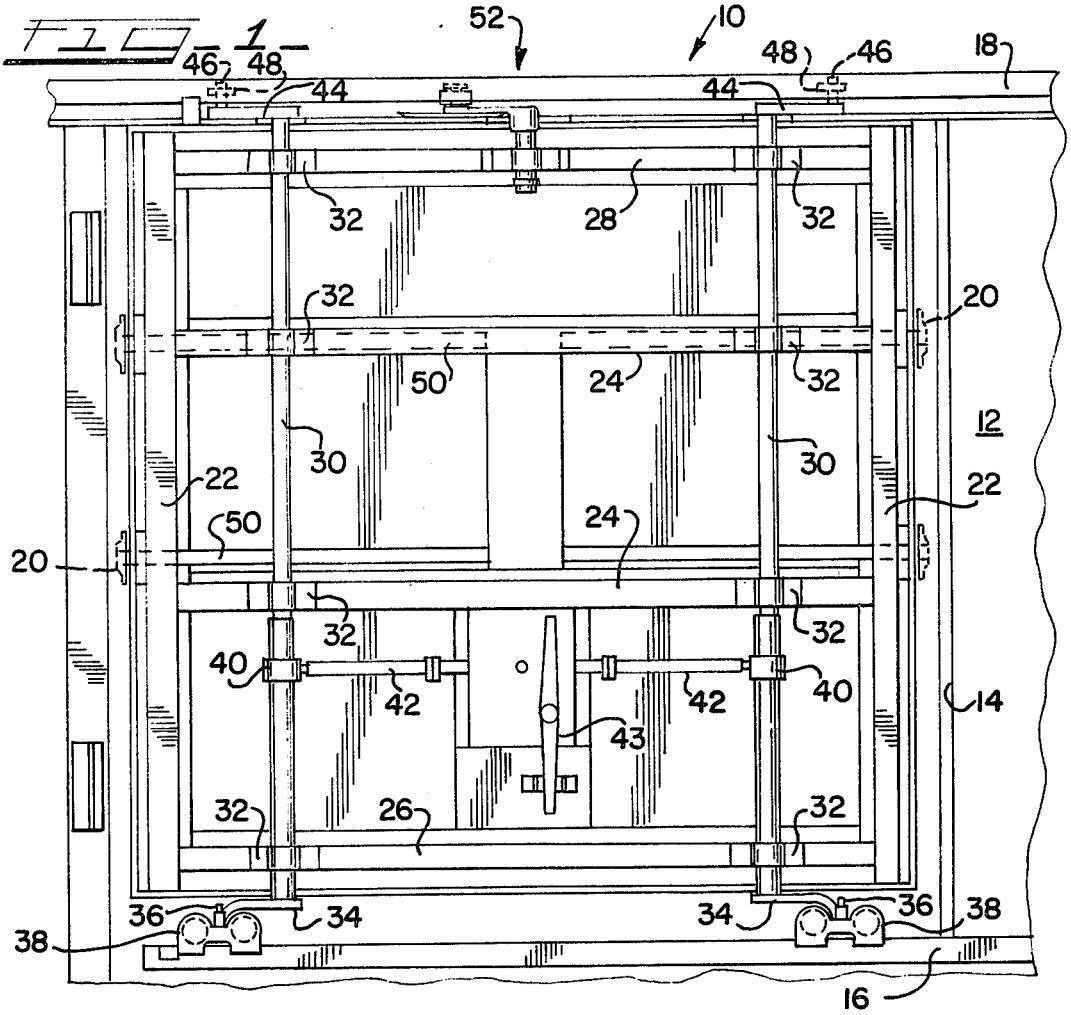
FIG. 1 is a side elevation view of a plug door constructed according to the present invention.
Figure 4:
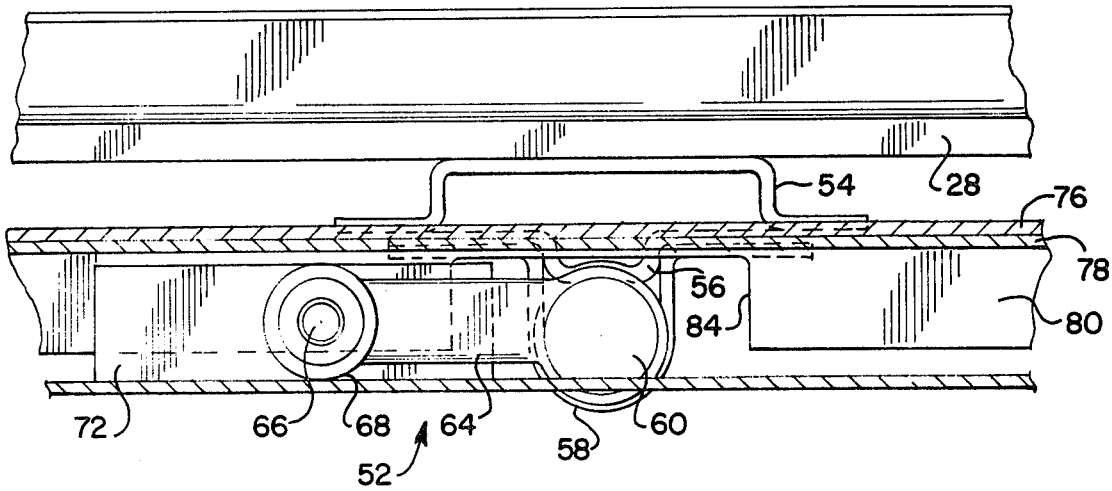
FIG. 4 is a top plan view of the safety roller assembly of FIG. 2.
Figure 2:
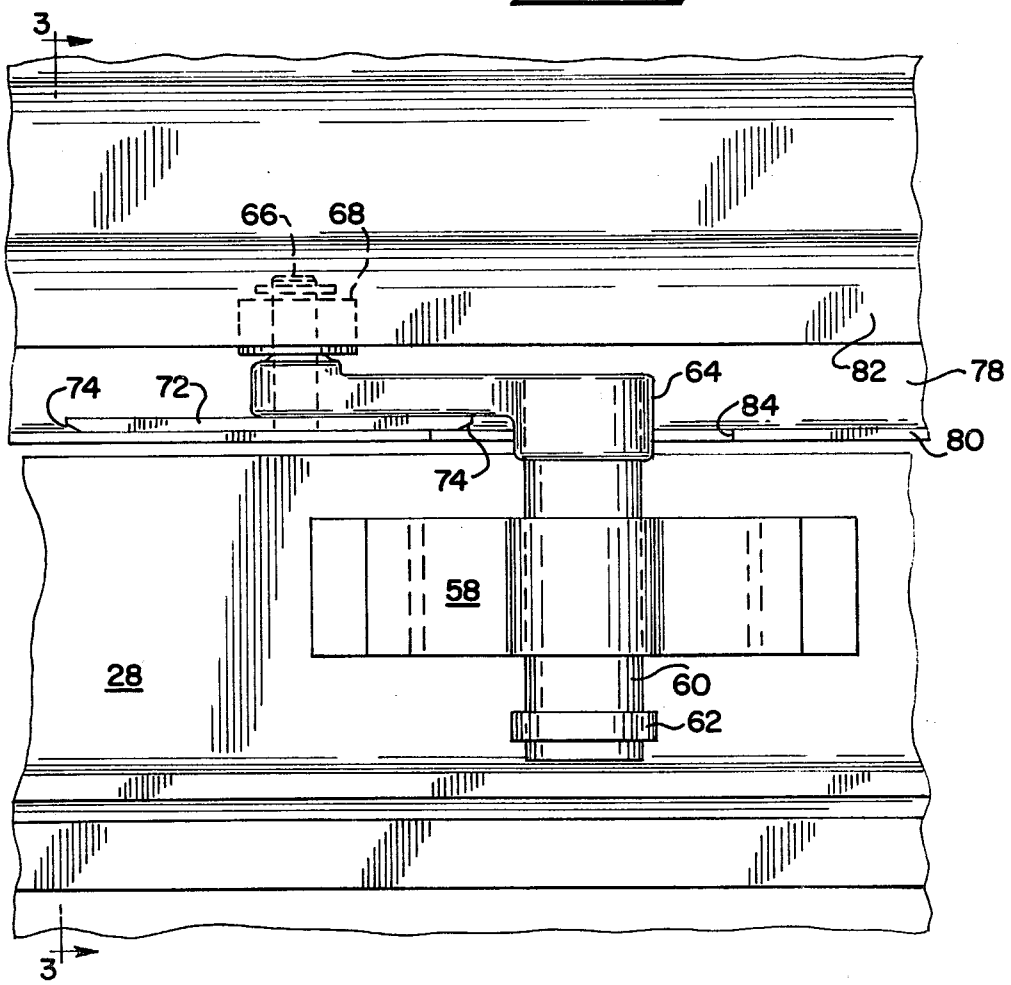
FIG. 2 is an enlarged, partial side elevation view of the safety roller assembly of the plug door of FIG. 1.

As can be seen in FIG. 1, the present invention is embodied in a railway car plug door, generally indicated at 10, installed in a side wall 12 of a railway freight car, the plug door 10 filling a door opening 14 in the side wall 12 in its closed position. Mounted on the inside of the side wall 12 are a lower guide rail 16 and an upper retaining guide 18 which are mounted below and above the door opening 14 respectively and both of which extend in at least one direction along the inside of the side wall 12 away from the door opening 14. A plurality of locking receptacles 20 are provided on the side wall 12 around the door opening 14.

The plug door 10 is a planar sheet member reinforced by side braces 22, center transverse braces 24 and a lower and upper transverse brace 26 and 28. A pair of vertically mounted operating rods 30 are secured within a series of journal members 32 mounted on each of the transverse braces 24, 26 and 28. At the lower end of each of the operating rods 30 is a respective lower connecting crank 34 which connects the operating rod 30 to a pivot joint 36 in a roller assembly 38. The two roller assemblies 38 are both entrained on the lower guide rail 16. Attached to each of the operating rods 30 partway along their length is a respective one of clevises 40. Each clevis 40 is attached to a connecting member 42 and both are connected to a handle 43 such that rotation of the handle 43 results in linear extension and retraction of the connecting members 42. At the top of each of the operating rods 30 is respective upper connecting crank 44 which connects the operating rod 30 to a roller pin 46 on which is mounted a roller 48. Both of the rollers 48 are received within the upper retaining guide 18. The plug door 10 also includes lock mechanisms 50 to insert within the locking receptacles 20 in the side wall 12 to lock the plug door 10 in its closed position.

Also mounted on the upper transverse brace 28 is a safety roller assembly, indicated generally at 52. The safety roller assembly 52, as can be seen in FIGS. 2–6, includes a wide U-shaped mounting bracket 54 having its wide base portion secured to the upper transverse brace 28. A pair of journal flanges 56 and 58 are mounted on the mounting bracket 54 with the ends of journal flanges 56 and 58 being welded together and welded in turn to the arms of the U-shaped mounting bracket 54. The journal flanges 56 and 58 have complementary curved portions formed in their intermediate portions so that they form a cylindrical journal to receive therein a safety crank pin 60. A retaining band 62 is secured on the safety crank pin 60 below the journal formed by the journal flanges 56 and 58 while the upper end of the safety crank pin is received within one end of a safety crank 64. The other end of the safety crank 64 receives pivotally therethrough a safety roller pin 66. Pivotally mounted in turn on the safety roller pin 66 above the end of the safety crank 64 is a safety roller 68. A retaining band 70 is fixed to the safety roller 68 adjacent its upper end. Mounted on the lowermost end of the safety roller pin 66 is a safety shoe 72. The safety shoe 72 is formed as an extended rectangular metal plate having its elongated axis oriented along the axis of the upper retaining guide 18. The safety shoe 72 may be either rotatably or fixedly secured to the safety roller pin 66 but is preferably fixedly secured to it so that the safety shoe 72 also serves as a retaining member at the lower end of the safety roller pin 66. At each of its extreme longitudinal ends the lower edge of the safety shoe 72 is provided with a bevelled surface 74.

Figure 3:
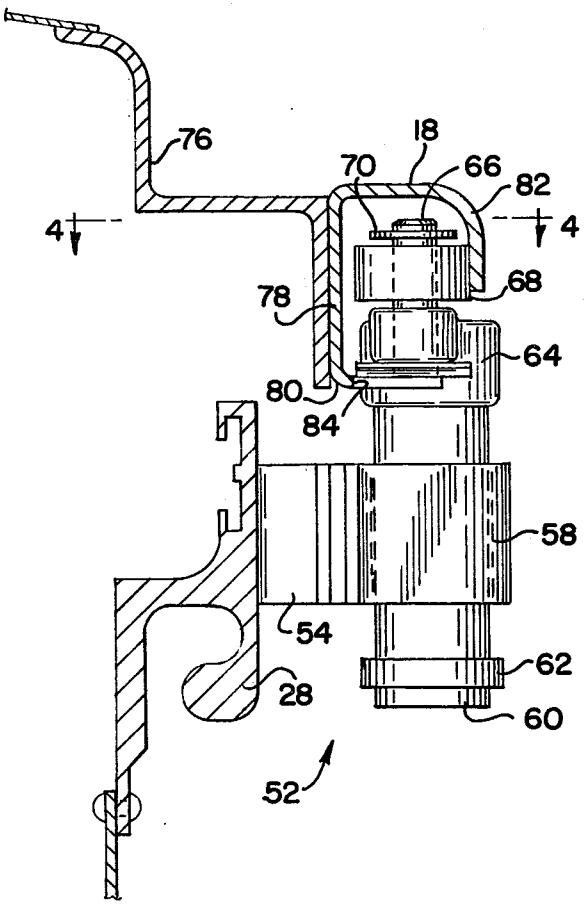
FIG. 3 is a cross-sectional view along the line 3—3 in FIG. 2.
Figure 5:
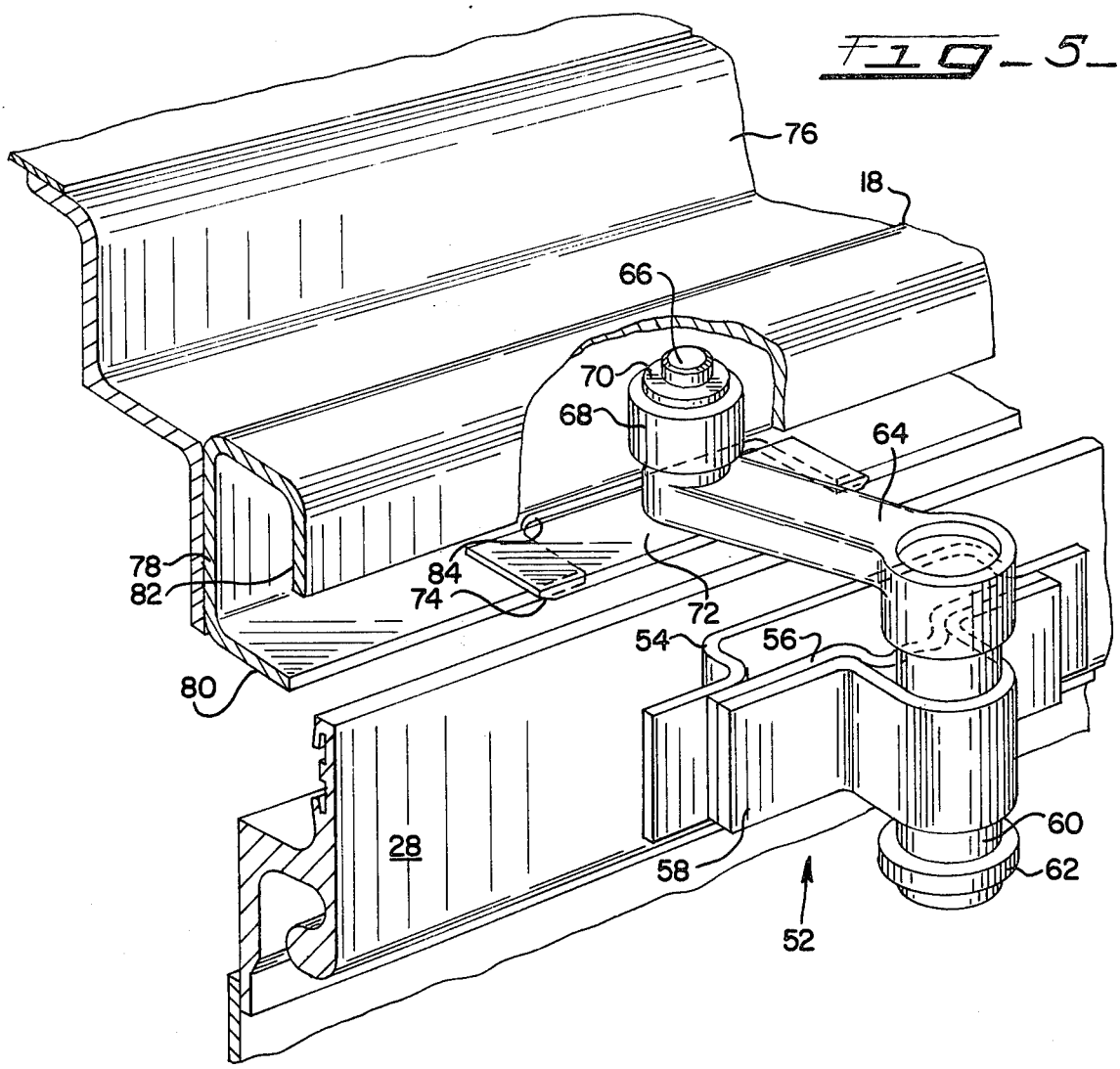
FIG. 5 is a perspective view of the safety roller assembly of FIG. 2 with the plug door being opened and a part of the retaining guide cut away.
Figure 6:
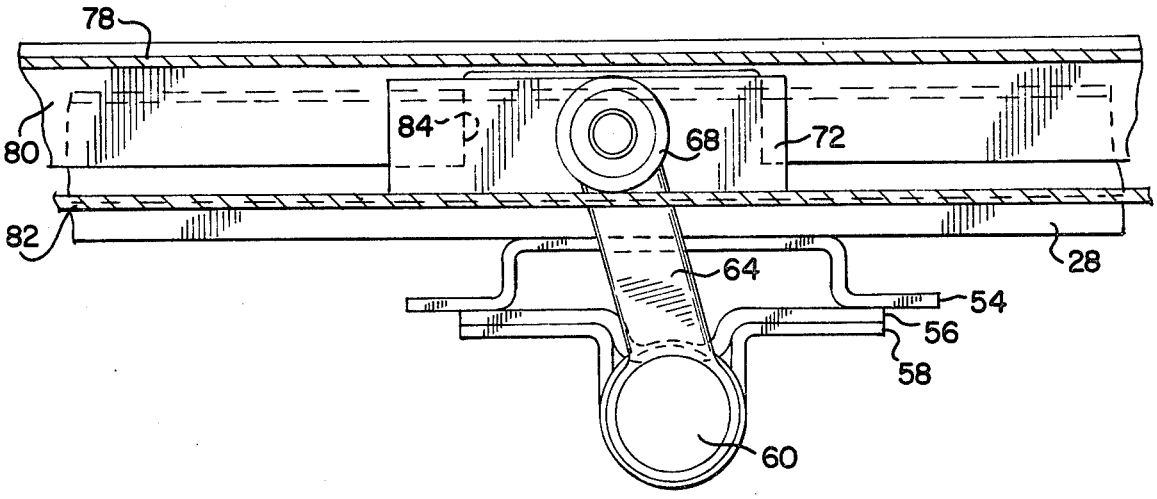
FIG. 6 is a top plan view similar to FIG. 4 of the safety roller assembly when the plug door is opened.

Details of the structure of the upper retaining guide 18 may be seen more clearly in FIGS. 3 and 5. The upper retaining guide 18 is fixed to a mounting flange 76 suitably attached to the side wall 12 of the railway car. The upper retaining guide 18 itself includes a vertical back plate 78 which is secured to the mounting flange 76 and from the bottom edge of which a horizontal support surface 80 extends. From the top edge of the back plate 78 a curved retaining surface 82 is formed extending outward and then downward so that the upper retaining guide 18 is closed on three sides and half of the other side with the gap remaining corresponding to the position of the safety crank 64. As can be seen in FIGS. 3 and 6, the safety roller 68 normally is in contact with the inside of the retaining surface 82. Formed in the support surface 80 at a location corresponding to the location of the safety crank pin 60 when the plug door 10 is closed, is a large rectangular recess 84. Similar recesses are also formed in the support surface 80 at appropriate locations adjacent the upper connecting cranks 44 to accommodate the upper ends of the operating rods 30.

In its operation the plug door 10 normally rests in its closed position as shown in FIGS. 1–4. The plug door 10 fills the opening 14 in the side wall 12 of the railway car. The lower and upper connecting cranks 34 and 44 are positioned generally parallel with the plane of the plug door 10. The safety crank 64 is in its position shown in FIGS. 2–4, with the safety crank 64 itself being positioned generally parallel to the upper retaining guide 18 and with the upper end of the safety crank pin 60 and the portion of the safety crank 64 surrounding the safety crank pin 60 both received within the recess 84 formed in the support surface 80. Also in this position the safety shoe 72 attached to the safety roller pin 66 is positioned aligned with the safety crank 64.

To operate the plug door 10 the handle 43 is operated which through the connecting member 42 rotates both of the operating rods 30. The rotation of the operating rods 30 causes the lower and upper connecting cranks 34 and 44 to pivot to a position angled with respect to the plane of the plug door 10 thereby lifting the plug door 10 inward into the interior of the railway car and out of the opening 14 in the side wall 12. When the plug door 10 is thus positioned, it is free to slide to the side out of the way riding along the lower guide rail 16. The rollers 48 are retained in the upper retaining guide 18 to keep the plug door 10 in its vertical position to keep it from falling over and off of the guide rail 16. Since there is a possibility of the lower roller assemblies 38 becoming derailed and since there is some possibility that the upper supports provided by the connecting cranks 44 and rollers 46 could either give way or fall through the various openings in the support surface 80, the safety roller assembly 52 is provided as a failsafe support to retain the plug door 10 in a vertical position and to keep it from falling over and causing damage or injury should it become derailed. For this reason it is most important that any possibility of the safety roller 68 becoming untracked must be precluded.

In the operation of the plug door 10, the safety crank 64 and the safety crank pin 60 are rotated and withdrawn from the recess 84 in the support surface 80 as the plug door 10 is lifted from the opening 14. The safety roller assembly 52 is rotated from its position shown in FIGS. 2–4 to that shown in FIGS. 5 and 6. The safety crank 64 is then angled with respect to the plane of the plug door 10 and the safety roller 68 rides along the inside surface of the retaining surface 82 as the plug door 10 travels sideways along the lower guide rail 16. As it travels along inside of the upper retaining guide 18, the safety shoe 72 prevents the safety roller 68 from ever falling through the recess 84 or other similar recesses in the support surface 80. The safety show 72 thus provides a fail-safe mechanism to ensure that the safety roller 68 can never become untracked, in spite of the provisions for the recesses in the support surface 80, and thus reduces the possibility of an accident caused by derailing of the plug door 10.

The length of the safety shoe 72 serves a dual function. First, of course, the length of the safety shoe 72 assures that it cannot pass through the recess 84 since it is simply too large. Secondly, the length of the safety shoe 72 assures its orientation in the proper direction inasmuch as any rotational movement of the safety shoe 72 would cause one of its ends to abut the back plate 78 of the upper retaining guide thereby preventing further rotation. The bevelled surfaces 74 on the ends of the safety shoe 72 serve to lift the safety shoe 72 over the edges of the recess 84 should the door 10 become slightly tilted as it travels. By fixing the safety shoe 72 to the safety roller pin 66 the safety shoe 72 can also serve a lower retaining member for the safety roller pin 66, the pin 66 merely rotating within the safety crank 64 changes. A further advantage of the use of the safety shoe 72 is that it allows greater leeway and tolerance in the manufacture of the recess 84 since its size and shape is no longer a safety factor as long as it is smaller than the safety shoe 72.

While the provision for the safety shoe 72 is most useful in conjunction with the safety roller 68, such a safety shoe could also be provided for the rollers 48 either alone or in conjunction with the safety shoe on the safety roller.

Inasmuch as the subject invention is subject to many variations, modifications, and changes in detail, it is intended that all the subject matter contained in the aforegoing description or in the accompanying drawings be interpreted as illustrative and not in a limiting sense.

What is claimed is:

1. A plug door assembly comprising a wall having an opening therein;

a generally planar plug door filling the opening in the wall in its closed position;

an upper retaining guide positioned on the wall above the opening and including a lower support surface;

a lower guide rail positioned on the wall below the opening;

a pair of vertical operating rods rotatably secured in the plug door;

handle means to cause rotation of the operating rods;

a connecting crank at each end of each of the operating rods;

a roller assembly attached to the lower connecting crank of each operating rod entrained for traveling along the lower guide rail;

a roller attached to the upper connecting crank of each operating rod and received within the upper retaining guide;

the rotation of the operating rods causing the connecting cranks to rotate to lift the plug door out of the opening in the wall so that it may clear said wall and travel along the lower guide rail;

the improvement comprising:

a safety crank, means rotatably securing said crank at one end to the plug door on a vertical axis for pivotal movement about said axis;

a safety roller, securing means mounting said safety roller on a vertical axis on the other end of the crank, said safety roller and securing means being received within the upper retaining guide;

the lower support surface of the upper retaining guide having at least one recess formed in it to receive the safety crank when the plug door is in its closed position; and a safety shoe pivotally mounted on said other end of the safety crank, said safety shoe being an elongated member longer than the recess in the lower support surface and serving to prevent the safety roller from ever being drawn through the recess in the lower retaining surface and means on said shoe being effective to lift said safety crank and thereby position said safety roller in a nonwithdrawable position within said upper retaining guide upon the door being moved from closed to open position.

2. A plug door assembly as claimed in claim 1 wherein the safety shoe is a rectangular member having its long axis oriented along the direction of the upper retaining guide.

3. A plug door assembly as claimed in claim 2 wherein said lift means comprises bevelled surfaces on the lower edge of the extreme ends of said safety shoe and said edges being operative to prevent the shoe from jamming in the recess when it is moved across the recess.

4. A plug door assembly as claimed in claim 1 wherein the safety shoe is fixedly secured to the crank by a safety roller pin.

5. A safety device for a door which is movable inwardly and outwardly respectively to close and open an access opening in a wall and then slide edgewise along upper and lower guides wherein the upper guide comprises a track and the door is provided with cranks having rollers guided within the track, the improvement comprising:

a safety crank mounted on the door and movable pivotally about a vertical axis with respect thereto and having a roller mounted on a vertical axis thereon guided within said track, said track having a generally horizontal support rail with a slot therein shaped to accommodate an upstanding portion of said safety crank therein in a predetermined closed position of the door and a safety shoe pivotally mounted to said safety crank on the vertical axis of said roller for movement longitudinally along the rail during sliding movement of said door and comprising an elongated element slidable upon said rail and of a length sufficient to readily span said slot, said element having beveled end portions of reduced thickness, said end portions adapted to cam the safety shoe out of jamming engagement with said slot and elevate said safety crank into a nonwithdrawable position with respect to said guide upon movement of the door moving said safety crank and shoe past said slot.

* * * * *